US007308941B2

(12) United States Patent
Rolovic et al.

(10) Patent No.: US 7,308,941 B2
(45) Date of Patent: Dec. 18, 2007

(54) APPARATUS AND METHODS FOR MEASUREMENT OF SOLIDS IN A WELLBORE

(75) Inventors: Radovan Rolovic, Cheltenham (GB); Stephen D. Hill, Pearland, TX (US); Frank Espinosa, Richmond, TX (US); John R. Lovell, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/010,116

(22) Filed: Dec. 10, 2004

(65) Prior Publication Data

US 2005/0126777 A1 Jun. 16, 2005

Related U.S. Application Data

(60) Provisional application No. 60/529,161, filed on Dec. 12, 2003.

(51) Int. Cl.
*E21B 21/00* (2006.01)

(52) U.S. Cl. ..... 166/312; 166/66; 166/222

(58) Field of Classification Search ..... 166/312, 166/66, 222, 250.1
See application file for complete search history.

(56) References Cited

U.S. PATENT DOCUMENTS

| | | | | |
|---|---|---|---|---|
| 5,458,198 | A | 10/1995 | Hashemi et al. | 166/312 |
| 6,062,311 | A | 5/2000 | Johnson et al. | 166/312 |
| 6,173,771 | B1 | 1/2001 | Eslinger et al. | 166/173 |
| 6,176,323 | B1 | 1/2001 | Weirich et al. | 175/40 |
| 6,607,607 | B2 | 8/2003 | Walker et al. | 134/18 |
| 2003/0057366 | A1 | 3/2003 | Gzara et al. | 250/269.3 |
| 2004/0007059 | A1* | 1/2004 | Tudor | 73/152.42 |

FOREIGN PATENT DOCUMENTS

WO 03/097997 11/2003

OTHER PUBLICATIONS

SPE 39300—*Cuttings Transport Problems and Solutions in Coiled Tubing Drilling,* L.J. Leising, I.C. Walton.
SPE 29267—*Two New Design Tools Maximize Safety and Efficiency for Coiled Tubing Pumping Treatments,* S.C. Gary, I.C. Walton and H. Gu.

(Continued)

*Primary Examiner*—William Neuder
*Assistant Examiner*—Nicole Coy
(74) *Attorney, Agent, or Firm*—Tim Curington; David Cate; Robin Nava

(57) ABSTRACT

Apparatus and methods for measuring solids in wellbore that include a bottom hole assembly having a sensor to measuring a characteristic indicative of solids in the wellbore. The measurement may be used to measure solids or solids suspended in fluid flow. The invention is useful for use in wellbore cleanouts. A computer model may be used and updated based on the measured characteristic. The input of measured characteristic and the updating of the computer model may be performed in real time whilst the wellbore cleanout operation is ongoing.

8 Claims, 1 Drawing Sheet

OTHER PUBLICATIONS

SPE 28222—*Development of a Computer Wellbore Simulator for Coiled-Tubing Operations,* Hongren Gu and I.C. Walton.
SPE 29491—*Computer Simulator of Coiled Tubing Wellbore Cleanouts in Deviated Wells Recommends Optimum Pump Rate and Fluid Viscosity*.
SPE 35341—*Optimizing Cuttings Circulation in Horizontal Well Drilling,* A.L. Martins, C.H.M Sa Petrobras, A.M.F. Lourenco and W. Compos.
SPE 37079—*State-Of-The-Art Cuttings Transport in Horizontal Wellbones,* Ali A. Pilehvari, J.J. Azar and Siamack A. Shirazi.
SPE 71727—*Flow Diagnosis and Production Evaluation in High Flowrate Oil-Water Producers Using Optical-Fibre Holdup Sensors,* R.R. Jackson, C. Ayan and J. Wakefield.
PressureTrax and Sand Trax—Acoustic Particle Monitor System, ILI Technologies Corp.
Clampon DSP Particle Monitor—Ultrasonic Intelligent Sensors.

* cited by examiner

APPARATUS AND METHODS FOR MEASUREMENT OF SOLIDS IN A WELLBORE

This application claims priority based on U.S. provisional patent application Ser. No. 60/529,161 filed Dec. 12, 2003.

FIELD OF THE INVENTION

This invention is relates to measuring solids in a wellbore, and more particularly to measuring or monitoring the cleaning of solids during a cleanout operation in an oil or gas wellbore.

BACKGROUND OF THE INVENTION

It is known to use drill pipe or coiled tubing to drill wellbores or to service existing wells to remove fill such as sand, scale, or other deposits in tubular members in the wellbore. It is desirable to remove drill cuttings in drilled wells or fill and deposits in existing wells to establish, restore, or improve the production of oil or gas or both from subterranean formations intersected by the wellbore. Generally in industry, removal from a wellbore of cuttings, fill, scale particles, other deposit particles, sand, and the like, collectively referred to herein as solids, is called well cleanout. Other reasons that removal of solids from a wellbore is desirable include to permit passage of wireline or service tools in the borehole, ensure the proper operation of downhole flow control devices, and remove material which may interfere with subsequent well service or completion operations.

The success of a cleanout operation normally is judged based on the reduction of the amount of solids in a borehole after cleanout. Cleanout job efficiency is a term that relates the reduction of the solids in a borehole after cleanout compared to the quantity of solids present in the borehole prior to the cleanout operation. The quantity of solids before and after a cleanout operation typically are estimated based on well configuration, pump rates, fluid properties, performance history, modeling, and field experience in similar situation among other factors, not on measurement. A method of reliably determining the quantity of solids present before and after a cleanout operation based on measurement or a measured characteristic indicative of the presence of solids is desirable.

Many factors affect cleanout efficiency and effectiveness; some of these factors specifically relate to the transport of wellbore solids from the wellbore during cleanout efforts. Discussions on solids transport in wellbores are presented in *Cuttings Transport Problems and Solutions in Coiled Tubing* Drilling, Leising, L. J, and Walton, I. C., IADC/SPE 39300, Mar. 3-6, 1998, pp 85-100, *Optimizing Cuttings Circulation in Horizontal Well Drilling*, Martins, A. L. et al., SPE 35341, March 1996, pp 295-304; and *State-of-the Art Cuttings Transport in Horizontal Wellbores*, Pilehvari, Ali A. et al., SPE 39079, November 1995, pp 389-393, each of which is incorporated herein in the entirety by reference. Wellbore characteristics such as temperature, pressure, and configuration can affect cleanout efforts; deviated and horizontal wells generally are more difficult to cleanout than vertical wells. Characteristics of the cleanout fluid are another factor. In addition, the characteristics of the wellbore solids such as particle size, shape and density may affect cleanout efficiency.

Computer models and simulators are known for use in modeling and simulating a well cleanout operation.

Examples of such are presented in *Development of a Computer Wellbore Simulator for Coiled-Tubing Operations*, Gu, Hongren and Walton, I. C., SPE 28222, July 1994; *Computer Simulator of Coiled Tubing Wellbore Cleanouts in Deviated Wells Recommends Optimum Pump Rate and Fluid Viscosity*, Walton, I. C., SPE 29491, April 1994; and *Two New Design Tools Maximize Safety and Efficiency for Coiled Tubing Pumping Treatments*, SPE 29267, Gary, S. C. et al., March 1995, each of which are incorporated by reference herein in the entirety.

Typically a well cleanout operation is considered a success if it results in increased well production or improved well access for performing subsequent wellbore operations. These operational improvements however are not readily observable or manifest during or immediately after the performance of a cleanout operation. As such, they do not provide a real time indicator as to whether or not a cleanout operation has been successfully performed throughout a wellbore. Similarly, existing methods known for use in determining the presence of solids in a wellbore, such as running a video camera or mechanical probe downhole, are not applicable for use during a clean out operation. An apparatus and methods to determine the success of a well cleanout operation in real time is needed to provide an operator with information expediently to determine if additional cleanout efforts are needed while the cleanout equipment and personnel are at the well site, thereby avoiding time and scheduling delays as well as the expense of remobilization in the event that additional cleanout efforts are required. The present invention addresses these needs.

SUMMARY OF THE INVENTION

The present invention provides apparatus and methods for detecting solids in a wellbore. A method is provided that comprises deploying a bottom hole assembly (BHA) into a borehole using a conveyance wherein BHA comprises a sensor assembly and measuring a characteristic indicative of solids in the wellbore using the sensor assembly. The conveyance may be any conveyance means suitable for deploying the BHA in a wellbore, including but not limited to tubing, coiled tubing, drill pipe, cable, wireline, slickline and wellbore tractor. In some embodiments, the sensor assembly may comprise an acoustic transmitter and receiver; optical transmitter and receiver; radioactive transmitter and receiver; and electromagnetic transmitter and receiver. The characteristic may be measured as the BHA is moved in the wellbore and the rate of movement or the BHA configuration may be adjusted in response to the measured characteristic. Measurements taken or received in the BHA may be communicated to the surface via a communication link such as wireline, slickline, optic fiber, wireless transmission, and pressure pulse. Often the measured characteristic is recorded, either in a processor or storage device in the BHA or in a storage device, computer processor, or surface operation equipment. In many embodiments, the BHA will further comprise a nozzle having one or more ports for delivering a fluid to the wellbore. In these embodiments, the measured characteristic may be indicative of solid particles in the fluid in the wellbore.

In an embodiment, the present invention provides a method for detecting solids in a wellbore fluid comprising deploying a bottom hole assembly (BHA) into a borehole, the BHA comprising a nozzle having one or more ports and a sensor assembly; flowing a fluid into the wellbore through at least one port in the BHA; suspending solids in the fluid flow in the wellbore; and measuring a characteristic indicative of solid particles suspended in the fluid using the sensor assembly. In some embodiments, the sensor assembly comprises an acoustic receiver and measuring the characteristic comprises receiving an acoustic signal with the receiver. The acoustic signal may be generated by a transmitter or may be generated by impingement of the solid particles suspended in the fluid flow on the BHA. The characteristic may be measured while the BHA is stationary in the wellbore or it may be measured as the BHA is moved in the wellbore on the conveyance. Routine methods of downhole conveyance are suitable, such as tubing, coiled tubing, drill pipe, cable, wireline, slickline or downhole tractor. In some embodiments the configuration of the BHA may be adjusted, such as through mechanical manipulation, based on the measured characteristic. The measured characteristic may transmitted to the surface in real time; it may be recorded at the surface or in a downhole storage device or processor in the BHA or both. Examples of suitable communication links include wireline, slickline, optic fiber, wireless transmission, and pressure pulse.

In an embodiment, a method for cleaning out a wellbore comprising deploying a bottom hole assembly (BHA) disposed on a conveyance into a borehole, the BHA comprising a nozzle having one or more ports and a sensor assembly; moving the BHA along the borehole to run-in-hole (RIH) at a running-in-hole rate; flowing a fluid into the wellbore through at least one port in the BHA; suspending solids in the wellbore in the fluid flow; measuring a characteristic indicative of solid particles suspended in the fluid using the sensor assembly; and moving the BHA in the borehole to pull-out-of-hole (POOH) at a pulling-out-of-hole rate. In particular embodiments, the conveyance may be coiled tubing and fluid flowed to the wellbore through the interior of the coiled tubing. The running-in-hole rate may be adjusted or the pulling-out-of hole rate may be adjusted based on the measured characteristic. The sensor assembly may include an acoustic receiver for measuring a characteristic comprising an acoustic signal generated by impingement of solid particles suspended in the fluid flow on the BHA.

In an embodiment, the present invention provides an apparatus for cleaning out a wellbore comprising a BHA connected to coiled tubing, wherein the BHA has a nozzle having at least one port and a device for measuring solids in the wellbore; a storage device, processor, or computer system for recording and storing measurements; a surface equipment system for deploying the BHA and coiled tubing in the wellbore and for retrieving the BHA and coiled tubing from the wellbore; and a fluid delivery system to flow fluid into the wellbore through the coiled tubing and BHA. The surface equipment system may comprise a computer model for designing the wellbore clean out. Inputs into the computer model may include fluid properties and wellbore properties and outputs may include target RIH rate and target POOH rate. A communication link from the BHA to the surface may be provided; the communication may be in real time. A recording device or processor may be provided in the surface equipment system, in the BHA, or both. The measurements may be used to update the computer model; the updating may be in real time. The computer model output may include an estimate of the degree of cleanout. The device for measuring solid particles may be an acoustic receiver that measures acoustic signals generated by impingement of the solid particles on the BHA.

In an embodiment, the present invention provides a method for operating a wellbore cleanout comprising using a computer model to generate initial job parameters; deploying a bottom hole assembly (BHA) disposed on a conveyance into a borehole, the BHA comprising a nozzle having one or more ports and a sensor assembly; moving the BHA along the borehole; flowing a fluid into the wellbore through at least one port in the BHA;

suspending solids in the wellbore in the fluid flow; measuring a characteristic indicative of solid particles suspended in the fluid using the sensor assembly; updating the computer models using the measurements; generating updated job parameters using the updated computer model; and modifying the operation based on the modified job parameters. The job parameters may include RIH rate, POOH rate, fluid flow rate, fluid characteristics, or BHA characteristics, among others. The sensor assembly may comprise an acoustic receiver and measuring a characteristic may comprise receiving an acoustic signal. The acoustic signal may be generated by impingement of solids suspended in the fluid flow on the BHA. A better understanding of the present invention can be obtained when the following description is considered in conjunction with the drawings.

DETAILED DESCRIPTION

Figure 1:
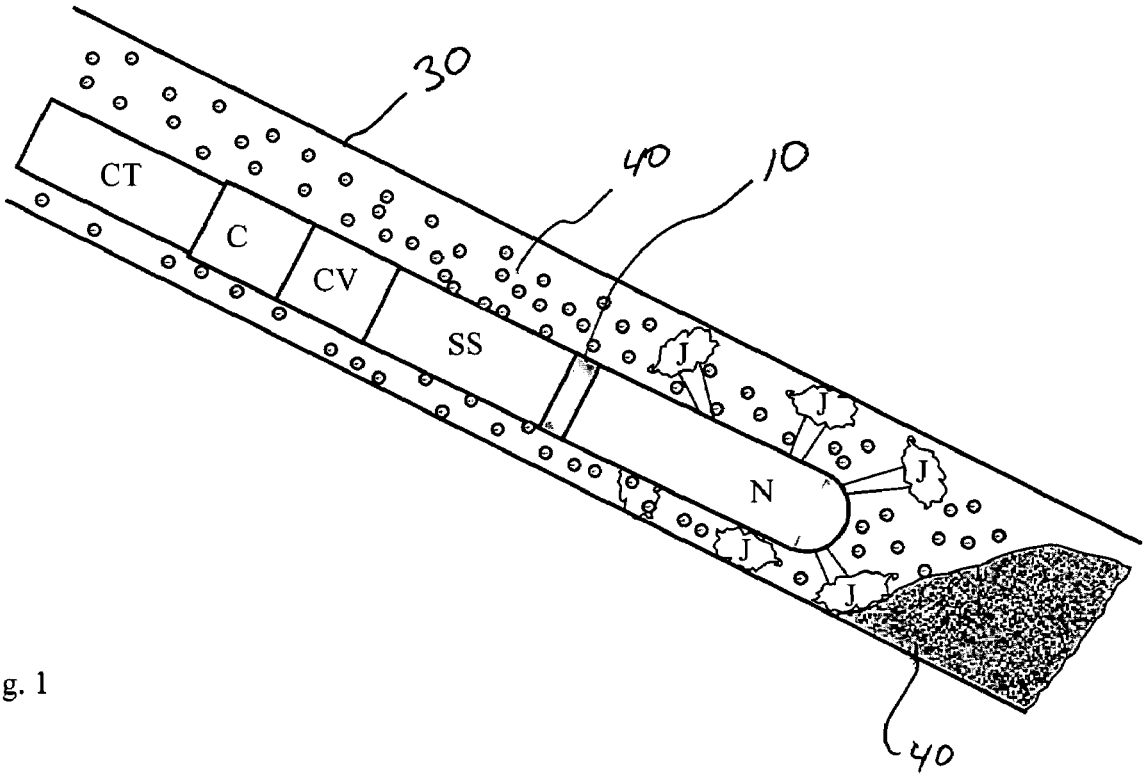
FIG. 1. illustrates the apparatus of the present invention deployed in a wellbore.

The present invention provides methods and apparatus for measuring solids in a borehole that are applicable for use during a coiled tubing (CT) wellbore cleanout operation. In the present invention, a bottom hole assembly (BHA) is deployed into a borehole on a conveyance, the BHA comprising a sensor assembly by which least one characteristic indicative of solids in the wellbore is measured. The sensor assembly comprises one or more sensors for receiving information or signals indicative of solids in the wellbore. In some embodiments the sensor(s) may be used to detect solids that are stationary and in other embodiments the sensor(s) may be used to detect solids that are suspended in fluid flow, such as when solids encountered in a wellbore are agitated by fluid flow through the BHA or in the wellbore.

Examples of the types of conveyance that may be used to deploy the BHA into the borehole include, but are not limited to drill pipe, coiled tubing, wireline, slickline, downhole tractors, and other such devices. In some instances, more than one conveyance may be used; for example, a wireline placed within coiled tubing may be used. In some embodiments, the conveyance may also provide a communication link from the BHA to the surface while in other embodiments a communication link separate from the conveyance may be provided. Although the present invention is useful for detecting solids in a wellbore wherein the BHA is stationary in the wellbore, in preferred embodiments, the BHA on the conveyance moves in the wellbore such that measurements are taken at various depths and locations.

In some embodiments, the solids-laden fluid is conveyed to the surface by pumping a fluid down one tubular and returning the fluid up the annulus between the tubular and the borehole wall. The present invention is also applicable for use in reverse wellbore cleanout operation wherein fluid is pumped down the annulus and the solids-laden fluid is returned to the surface via the interior of the tubular. In addition, the present invention is useful when multiple flow paths are provided. For example, when more than one conveyance is provided such as one coiled tubing is spooled inside a second coiled tubing, a multiplicity of fluid paths may be created. In such configurations, the fluid may be pumped down the annular space between the two coiled tubings and returned to the surface via the interior of the innermost coiled tubing. The sensor assembly of the present invention may be configured to permit fluid flow therethrough for particular application to reverse or multiple flowpath wellbore cleanout operations.

Examples of types of suitable sensors include acoustic sensors such as sonic or ultrasonic receivers, radiation sensors, electromagnetic sensors, and optical sensors. One or more sensors may be included in the sensor assembly; in the event that more than one sensor is provided, the sensors may be of the same or different type. In some embodiments in which more than one sensor is used, the measurements taken by each sensor may be collectively or separately tracked, and if separately may be correlated with the orientation of each sensor in the sensor assembly and BHA.

Examples of sensors that are suitable for use in the present invention and that are commercially available include, but are not limited to, mechanical sensors such as the Pipeview multi-fingered caliper manufactured by Schlumberger, acoustic sensors such as ClampOn Particle DSP monitor or the SandTrax system manufactured by ILI Technologies; densitometers such as FloWatcher used by Schlumberger; ultrasonic sensors such as those in the Ultrasonic Compensated Imager (UCI*) manufactured by Schlumberger; electromagnetic sensors such as the Coriolis Flowmeter manufactured by MicroMotion, the Promass 80 manufactured by Endress & Hauser and as used in the Array Resistivity Compensated (ARC*) logging tool manufactured by Schlumberger; and optical sensors such a gas holdup optical sensing tool (GHOST*) used by Schlumberger.

In some embodiments of the sensor assembly, a transmitter may be provided in addition to the sensor (receiver) that measures a characteristic indicative of solids in the wellbore. Alternatively a transducer may be used in a transmitting mode and in receiving mode.

One device for measuring the internal diameter of a casing, tubing or open borehole uses high-frequency ultrasonic signals. The measurement has high resolution and is used to detect deformations, the buildup of sand or scale, or metal loss due to corrosion. A transducer (in transmit mode) emits a high-frequency pulse that is reflected by the pipe or borehole wall back to the transducer (in receive mode). The diameter is determined from the time of flight of this echo and the fluid acoustic velocity. The transducer may be rotated to produce a cross section of the borehole size and full-coverage images of the borehole wall and the build-up of cleanout material within the wellbore. Such a sensor is available on the UCI tool.

Another in-situ measurement of the inside diameter of a casing or tubing uses an electromagnetic technique. A solenoidal coil centered inside the casing or tubing acts as a transmitter to generate an alternating magnetic field. Another coil, disposed a distance along the tool from the transmitter, acts as a receiver to measure the phase shift introduced by the casing. At high frequency, the signal penetrates less than a tenth of a millimeter into the casing, and the phase shift can be related to the casing internal diameter. For the purpose of detecting wellbore fill, the electromagnetic method can be used in combination with the ultrasonic method, because both sensors respond to different parameters. Such sensors are available on the ARC tool.

When an optical sensor is used, an optical transmitter such as a light source or diode may be used to provide a light signal in the solids in the borehole or the fluid flow in the borehole in which solids have been suspended such that the reflections and refractions of the light are returned to the optical receiver. Changes in the returned signal are used as measurements indicative of an increase or decrease in the concentration of solids in the wellbore or fluid.

In the BHA, and in some embodiments within the sensor assembly, another types of sensors may be provided in addition to the sensors for measurement of solids for measurement or monitoring of another property or properties during a wellbore cleanout operation. For example, temperature or pressure sensors may be provided to monitor wellbore conditions or a sensor for measuring one or more fluid properties such as viscosity, density, gel strength, may be provided. Such sensors and use thereof are known to those skilled in the art.

The sensor assembly comprises a sensor, and in some embodiments may further comprise a housing, a power source, a processor, or a recording device. The power source may be self-contained such as a downhole battery, an external source such as a wireline or other operational source, or may be chargeable and rechargeable through the conversion of localized power such as an optical signal or a mechanical spinner in the fluid flow.

In some embodiments, a communication link from the BHA to the surface operation is provided to permit transmission of measurement data from the sensor(s) to the surface. Examples of suitable communication links include but are not limited to wireline, slickline, optic fiber, wireless transmission, and pressure pulse. In this manner, measurements indicative of solids in the wellbore may be taken and monitored in real time during a cleanout operation. After transmission of the BHA measurements to the surface operation, processing or interpretation of the measurement may be performed. For example, solids in fluid flow detected by the sensor assembly should theoretically be transported to the surface after a prescribed volume of fluid is pumped. By comparing the theoretical prescribed volume of fluid to the actual volume of fluid pumped needed to transport the solids to the surface, the overall process may be monitored. These monitoring results provide information useful to refine models such as job planning models or real-time operational models.

Alternatively, or in addition to transmission to the surface, the measurement data may be stored locally to a storage device, such as memory gauge or a processor disposed in the BHA. The storage device may be downloaded between cleanout operations or whenever the BHA is removed out of the wellbore. This memory gauge data could be used to adjust the parameters of the remaining cleanout or for post-job evaluation to the next wellbore cleanout.

Such monitoring may permit the operator to perform cleanout operations more efficiently by determining the location and amounts of solids in the wellbore, confirming the degree of wellbore cleanout, and has been cleaned, avoiding leaving coiled tubing stuck in the hole due to solids settling around the tubing, and optimizing wellbore cleanouts parameters such as coiled tubing speed, either while being run-in-hole (RIH) or during pulling-out-of-hole (POOH), or both, and to adjust fluid pump rates and in some instances, fluid properties such as viscosity.

In some embodiments, the BHA further comprises a nozzle having one or more ports through which fluid flows while the BHA is being RIH or POOH, the wellbore solids being agitated by the fluid flow and suspended in the flowing fluid. In these embodiments, the contact of solids suspended in the fluid flow with the sensor assembly, BHA, borehole structures, or other tubulars may generate wave energy that is sensed by the acoustic sensor; such generation may be in lieu of or in addition to an acoustic transmitter. When a large amount of solids are being agitated during the cleanout operation, a higher level of acoustic activity will be measured. As the amount of sand in the borehole decreases during the cleanout process, the acoustic sensor will measure a decreasing amount of energy, thereby providing a measurement of the effectiveness of the cleanout process. When little to no sand remains in the borehole to be suspended by the circulating cleanout fluid, then the downhole sensor will measure little to no energy, indicating a high to complete level of wellbore cleanout. The cleanout fluid may be a Newtonian fluid such as water or a non-Newtonian power law fluid, such as a visco-elastic surfactant (VES).

Several suitable types of nozzles are known, for example U.S. Pat. No. 6,173,771 and U.S. Pat. No. 6,602,311, each of which are incorporated herein in their entirety by reference. While the dynamics of the solids in the fluid flow may vary depending on the nozzle configuration used, the use of the detection or measurement of a change in property indicative of solids in the wellbore remains the same. For instance, if a BHA with multidirectional jets is used, the solid particles will be moved from the front of the nozzle towards the back due to the motion of the fluid from the plurality of jets. As solid particles are encountered, the sensor detects the particles through a change in a measured property. Examples of such properties that could be measured by a borehole sensor include but are not limited to kinetic energy of the collisions of the solids on the wall surface, in density of the surrounding fluid, magnetic field around the BHA, or source count of distribution of gamma ray particles around the BHA.

When a change in measured property occurs, the sensor measures a signal or reading from this change incident. For example, a change in acoustic signal may be interpreted as an increase in the solids measurement, a decrease in the solids measurement, a confirmation that no solids are present or a random noise event. This measurement may transmitted to the surface via a communication link to a surface operation comprising a processor (computer, hand held, etc) for recording, storage, further interpretation or displaying the information. Alternatively the processor may be stored downhole in the BHA or sensor assembly. If the measurement is within a certain prescribed range, such as frequency, energy, density, the processor may be programmed to interpret the signal or reading as a known event. From this information, job procedures can either be verified or modified to optimize the process. For example, the measured data may be used to determine the location of sand in the borehole, an increase or decrease in the quantity of solids present; to measure the effectiveness of the cleanout process; to confirm a high level of cleanout of the borehole; to adjust job parameters such as pump rate or RIH or POOH speed to optimize job operations; to determine whether an alternative fluid could be suitably substituted in the cleanout process; or as an alert to the operation of changing borehole or cleanout job parameters. Also the measurement may be used to manipulate or moving a mechanism, such as a J-slot or sliding sleeve, to operate a BHA in a different position or to change the flow characteristics such that it would be evident on surface that the event had occurred.

Referring now to FIG. 1, an embodiment of the present invention is shown wherein the BHA 10 is deployed in a wellbore 30, the BHA comprising a sensor assembly SS wherein acoustic sensors are disposed within a housing, the acoustic sensors being used to detect particles that impinge on the sensor assembly (SS). In the embodiment shown, the sensor assembly SS is placed behind (uphole) the nozzle. The jetting action of fluid dispelled through nozzle ports (J) agitates solids 40 when encountered in the wellbore. The agitated solids 40 are moved about and transported upward in the wellbore in a turbulent flow, passing the sensor assembly (SS) and other BHA components such as optional check valve (CV) and coiled tubing connector (C).

Many agitated solids impinge on sensor assembly (SS) as they are transported up the wellbore, the impingement being detected or measured by the acoustic sensors in the sensor assembly (SS). Based on the kinetic energy of the particles that impinge on the sensor assembly (SS), acoustic (mechanical) waves are produced in the sensor assembly. The amplitude of these acoustic waves is directly proportional to the amount of particle kinetic energy that was spent to generate these waves. The amount of particle kinetic energy may be calculated as one half of particle mass times the particle velocity squared. The velocity of particles is approximately equal to the fluid velocity and may be determined from the known input fluid flow rate and geometrical parameters of the BHA and wellbore. The particle mass is the unknown that is approximately determined in this process from the measured kinetic energy of the particles and the resulting acoustic wave amplitudes. All produced wave amplitudes may be summed to determine the total amount of solids that impinge on the sensor assembly. Using this information, the total amount of solids in the flowing fluid passing the sensor assembly may be estimated based on empirical correlations, data obtained from a full-scale test loop, database information, or pre-job computer modeling. For the purpose of measuring the removal of solids or determining whether there are solids present in the wellbore, or determining whether there is a small or large amount of solids in the wellbore, there is no need to determine the actual amount of solids; it suffices to measure or monitor the change in a property indicative of solids in a wellbore.

A direct measure of the acoustic wave amplitudes may used to determine if any solids are passing by the sensor assembly. This direct measure also may be used to estimate whether a small or large amount of solids are being transported in the cleanout fluid up the wellbore. For a more precise estimate of the amount of solids transported up the wellbore, correlations that include fluid viscosity, fluid velocity, type of fluid and other factors, may be incorporated into the processor for processing in real time or at some later time. In some embodiments, a processor may be placed in the sensor assembly and used to process the sensor information to provide a measure of particles flowing up the wellbore. The information can also be stored on a local data storage device and retrieved at any time during the job or when the BHA is pulled back to surface for post-job evaluation or planning of the next job. The present invention is useful to detect if there are any solids in the wellbore and whether there is a small or large amount of solids in the wellbore without requiring system calibration or correlations with experimental data.

Measured or processed information may be transmitted to the surface in real time via a communication link means such as optical fiber, wireline, pressure pulse or other readily available means. In the case of ultrasonic detection of solids, the sensor sub itself may comprise one or more ultrasonic sensors, a digital signal processor, and a unit for sending and/or converting the information to be sent to a computer at surface. When an optical fiber communication link is used, the measurement data may be converted into a light signal in the sensor assembly (SS), and the light signal is later converted into a digital signal at either the BHA or surface processor or both for further computer processing and data display. In the case signal and data transfer via wireline, the measurement data may be converted into electrical signals in the sensor assembly (SS) and later converted into a digital signal the BHA or surface processor or both for further computer processing and data display. Simplified measurement information also can be sent to surface via pressure pulse telemetry.

In application, wellbore cleanout procedures or related job parameters can be adjusted to optimize the cleanout job based on measurement of wellbore solids as describe above. For example, when the actual thickness of wellbore solids fill is not known precisely or not known at all, the coiled tubing can be run in the hole (RIH) at a higher speed until solids are detected rather than a lower speed based on an assumed depth of solids. When the amount of solids is low or minimal, the conveying speed may be increased to reduce the job time and fluid volume, and the conveying speed may be lowered again if a significant amount of solids is detected. When a significant amount of solids is detected, the BHA may be run through the solids at a predefined conveying speed that is typically lower than the conveying speed when no solids are present in the wellbore. The overall cleanout operation may be automated via real-time processing of solids detection/measurement information and a computer controlled operation of the surface equipment system for deploying the BHA and coiled tubing and the fluid delivery system to flow fluids into the wellbore and for adjusting the coiled tubing RIH/POOH process based on the solids measurements and cleanout job design software. The RIH and POOH coiled tubing speeds are dependent on the amount of solids in the wellbore, cleanout fluid, and fluid velocity. Software such as the CoilCADE (a mark of Schlumberger) program can be used to determine the coiled tubing RIH and POOH speed based on these parameters. A larger amount of solids requires lower coiled tubing speed and vice versa. Fluid flow rate and/or fluid properties, such as viscosity and fluid additives, may also be adjusted to optimize the cleanout procedure based on detection/measurement of solids. Larger amount of solids encountered in the wellbore can be removed at a faster coiled tubing speed (RIH and POOH) when the fluid velocity is increased. Similarly, a higher fluid viscosity typically leads to a faster cleanout of the same amount of solids.

At the end of a cleanout operation, the coiled tubing may be deployed in the well up to the maximum depth and then pulled-out-of-hole at a certain speed to determine whether the well is completely free of solids. If solids are encountered, they are thrown back by fluid flow jetting through the nozzle such that fluid turbulence and impingement of suspended solids in the fluid on the sensor assembly produces an acoustic signal for measurement that indicates presence of solids in the wellbore. If during such a CT deployment to the maximum depth and then pulling-out-of-hole past any obvious restrictions, deviations, or other wellbore completions that may obstruct the solid particle flow out of the wellbore and no solids are detected, the well can be considered free of solids.

While preferred embodiments of the present invention have been illustrated in detail, it is apparent that modifications and adaptation of the preferred embodiments will occur to those skilled in the art. However, it is to be expressly understood that such modifications and adaptations are within the scope of the present invention as set forth in the following claims.

What is claimed is:

1. A method of cleaning a wellbore comprising the steps of:

deploying a bottom hole assembly (BHA) in the wellbore, the BHA carrying an acoustic receiver;

moving the BHA in the wellbore at a running-in-hole rate;

measuring by the acoustic receiver the acoustic signals of impingement of solids in the wellbore on the BHA;

estimating a relative solids amount in the wellbore from the measured acoustic signals; and adjusting the running-in-hole rate based on the estimated relative solids amount.

2. The method of claim 1, wherein the BHA is conveyed into the wellbore by coiled tubing.

3. The method of claim 1, further including the step of agitating the solids in the wellbore by injecting fluid through the BHA into the wellbore.

4. The method of claim 3, wherein the BHA is conveyed into the wellbore by coiled tubing.

5. The method of claim 1 wherein the acoustic signals measured by the acoustic receiver are recorded.

6. The method of claim 5 wherein the measured acoustic signals are transmitted via a communication link to the surface in real time and the recording is at the surface.

7. The method of claim 1 wherein the BHA further comprises a nozzle having one or more ports for delivering a fluid to the wellbore and the measured characteristic is indicative of solid particles in the fluid in the wellbore.

8. The method of claim 1 wherein the BHA is connected to a communication link selected from the group consisting of wireline, slickline, optic fiber, wireless transmission, and pressure pulse.

* * * * *